United States Patent [19]

Ishii et al.

[11] Patent Number: 4,570,695

[45] Date of Patent: Feb. 18, 1986

[54] THIN METAL BAND AND A METHOD FOR THE MANUFACTURE OF THE SAME

[75] Inventors: Takashi Ishii; Shinichi Murata, both of Tokyo; Shiro Kusagawa, Yokohama; Miyoshi Wakasaki, Kawasaki, all of Japan

[73] Assignee: Tokyo Shibaura Denki Kabushiki Kaisha, Japan

[21] Appl. No.: 593,303

[22] Filed: Mar. 26, 1984

[30] Foreign Application Priority Data

Mar. 31, 1983 [JP] Japan ..... 58-55931

[51] Int. Cl.[4] ..... B22D 11/06

[52] U.S. Cl. .....166/335; 175/171; 222/606; 425/363; 425/376 B

[58] Field of Search ..... 164/133, 423, 427, 429, 164/463, 475, 479, 488; 222/598, 600, 606; 425/363, 376 R, 376 B, 380, 383, 470, 471

[56] References Cited

U.S. PATENT DOCUMENTS 4,144,926 3/1979 Liebermann ..... 164/463

4,285,386 8/1981 Narasimhan ..... 164/463

4,485,839 12/1984 Ward ..... 164/463

*Primary Examiner*—Lowell A. Larson

*Assistant Examiner*—Jorji M. Griffin

*Attorney, Agent, or Firm*—Cushman, Darby & Cushman

[57] ABSTRACT

This invention provides a method for manufacturing a burr-free thin metal band by jetting molten magnetic metal from a nozzle onto a rotating cooling roll or a running cooling belt to permit it to be solidified. During the manufacture of such burr-free metal band, the width of a metal band to be obtained is also varied by swinging the nozzle within a predetermined angle range with respect to the direction of the width of the rotating cooling roll or the running cooling belt, or by varying the nozzle's opening length with respect to the direction of the width of the cooling roll or the cooling belt. According to this method it is possible to obtain a thin metal band having a central section with a uniform width, and first and second sections having a gradually narrowing width.

32 Claims, 10 Drawing Figures

THIN METAL BAND AND A METHOD FOR THE MANUFACTURE OF THE SAME

BACKGROUND OF THE INVENTION

1. Field of the Invention

This invention relates to a method for manufacturing a thin metal band which is capable of readily and arbitrarily varying the width of the band, and a thin metal band manufactured according to this method.

2. Explanation of the Prior Art

A winding core for use in a static induction machine, such as a transformer, is manufactured by coiling a silicon steel band. Such a winding core is divided beforehand into two parts, since it is not possible to wind a coil wire on an original intact form of winding core. The two core parts are assembled into one unit after these two core parts have been individually wound by a coil wire. However, a transformer equipped with such a winding core experiences the degeneration of the magnetic properties due to the presence of the divided parts of the winding core unit. A transformer having a substantially circular cross section is known as an improved transformer. This transformer is obtained by placing a split bobbin around the outer periphery of the winding core and winding a coil wire around the bobbin on the winding core, while turning the bobbin unit. Therefore, it is not necessary to divide the winding core into two units. This type of transformer can improve the magnetic properties.

The winding core having a substantially circular cross section is obtained by winding a thin metal band having a first section of a gradually increasing width, a central section of a uniform width merging with the first section and a second section of a gradually decreasing width merging with the central section. The thin metal band of such a configuration is formed by rolling a metal sheet into a thin metal band of a uniform width at a rolling step and cutting the thin metal band at a cutting step into a desired configuration. However, this step requires an additional cutting step for obtaining the first and second sections, resulting in a lower yield.

Recently, a winding core has been proposed which is formed of an amorphous, magnetic thin alloy band. This alloy band is formed by flowing a molten metal-metalloid alloy onto a rotating cooling roll or a running cooling band to permit it to be quenched. The thin metal band has excellent magnetic properties with a lower core loss.

SUMMARY OF THE INVENTION

This invention has been achieved by taking into consideration the manufacture of a thin alloy band through the quenching of a molten magnetic alloy.

The object of this invention is to provide a method for manufacturing a thin metal band in which the width of the metal band is adjusted, the yield is increased, and the number of manufacturing step is reduced, and to provide a thin metal band manufactured by the method.

According to this invention it is possible, during the manufacture of a thin metal band through the quenching of molten magnetic metal, to continuously vary the width of the thin metal band.

The width varying step, for example, comprises gradually increasing the width of the band from one end thereof toward a central section to be formed, maintaining the width of the band uniformly for a predetermined time period to provide the central section, and gradually decreasing the width of the band from the central section toward the other end thereof. Thus, the width of the thin metal band can be adjusted simultaneously with the manufacture of the thin metal band. It is therefore possible to obtain a winding core of a substantially circular cross section and it is thus possible to coil a coil wire around the outer surface of the winding core without dividing the winding core into two parts, whereby a transformer is obtained. According to this method, it is not necessary to provide any additional cutting step for cutting the side edges of each end section of the thin metal band, whereby a high yield is assured. As a result, a burr-free thin metal band can be obtained due to the absence of the additional cutting step. It is therefore possible to prevent shorting from occurring between the turns of the thin metal band due to a possible burr.

BRIEF DESCRIPTION OF THE DRAWINGS

This invention will be described below by referring to the accompanying drawings.

DETAILED DESCRIPTION OF THE PREFERRED EMBODIMENT

A method of this invention comprises adjusting the width of a thin metal band, while manufacturing the thin band through the quenching of a molten magnetic alloy, by continuously varying the width of the band.

Figure 1:
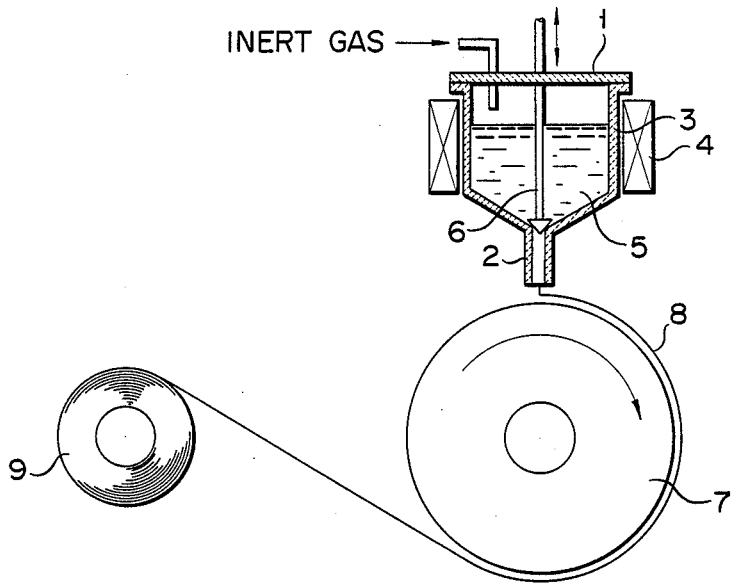
FIG. 1 is a diagrammatic view showing a method of this invention which manufactures a thin metal band using a single cooling roll.
Figure 2:
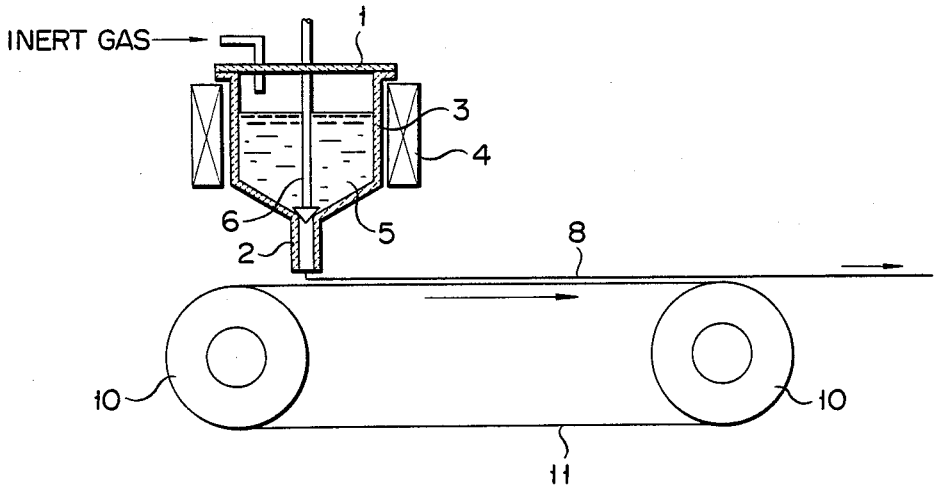
FIG. 2 is a diagrammatic view showing a method of this invention which manufactures a thin metal band using a cooling belt.

According to this invention, a method using a single cooling rool as shown in FIG. 1 or a cooling belt as shown in FIG. 2 is used in the manufacture of a thin metal band through the quenching of a molten magnetic alloy. The former method comprises the steps of disposing a nozzle 2 having a rectangular opening below the lower end of a heat-resistant, corrosion-resistant container 3, such as a crucible, sealed by a covering 1. This causes the magnetic alloy within the container to be melted by a high frequency heating means 4, which is arranged around the container 3. An inert gas, preferably an argon gas is injected into the container to compress the molten magnetic alloy within the container. A stopper rod 6 which blocks the nozzle 2 is raised away from the nozzle some time after the compression step to open the nozzle. When this is done, the melt 5 is jetted from the nozzle 2 onto a fast rotating cooling roll 7. The melt 5 in contact with the peripheral surface of the cooling roll is quenched due to the presence of a water cooling means, not shown, and solidified to provide a thin metal band. The thin metal band is supplied from the cooling roll 7 to, for example, a take-up roll 9 where it is continuously wound thereon.

The composition of the melt 5 depends upon the property of the thin metal band obtained. Where a thin metal band made of a crystalline magnetic alloy is to be obtained, the composition is selected from a known alloy composition for the winding core, such as a silicon steel or a permalloy. Where a thin metal band made of an amorphous, magnetic alloy is to be obtained, use is made of a known amorphous alloy composition made of, for example, 70 to 80 atomic percent of one or more kinds of metals selected from the group consisting of iron, nickel and cobalt, 20 to 30 atomic percent of one or more kinds of metalloids selected from the group consisting of silicon, boron, phosphorus, carbon, aluminum and germanium and, if necessary, 10 atomic percent of one or more transition metal elements such as titanium, niobium, vanadium and tantalum to improve the magnetic properties. According to this invention, an amorphous magnetic alloy is particularly effective in the manufacture of a thin metal band, since excellent magnetic properties, such as a lower iron loss, are obtained. The pressure of the inert gas under which the melt 5 is compressed is preferably 0.2 to 0.5 $kg/cm^2$. The thickness of the thin metal band obtained can be adjusted by controlling the pressure of the inert gas and thus the amount of melt jetted from the nozzle 2. The open end of the nozzle 2 through which the melt 5 is jetted is located perpendicular to the rotational direction of the cooling roll 7 such that the nozzle opening corresponds to the width of the thin metal band obtained. The length of the nozzle opening as viewed in the rotational direction of the cooling roll 7 is normally 0.1 to 1.0 mm, though being properly selected dependent upon the composition, temperature, etc. of the melt 5 and upon the properties of the material of which the nozzle is made. The nozzle 2 is normally made of a high thermal shock-resistant ceramic, such as quartz or alumina, which is selected according to the composition of the melt 5. In order to make the width of the thin metal band 8 accurate it is preferable that the space between the nozzle and the surface of the cooling roll be as narrow as possible. It is preferable that the spacing between the nozzle 2 and the cooling roll 7 correspond to the thickness of the thin metal band obtained. In this case, the opening of the nozzle is as close as possible to the cooling roll 7.

The cooling roll 7 for cooling the melt 5 is normally made of copper or a copper alloy such as beryllium copper, chromium copper, zirconium copper or chromium-zerconium copper, which has an excellent thermal conductivity and a good structual strength at high temperatures. Where a thin band of a crystalline metal is to be formed on the cooling roll 7, it is only necessary that the cooling roll 7 be rotated fast enough to permit the melt to be solidified. Where, however, a thin band of an amorphous metal is to be obtained, it is necessary to rotate the cooling roll 7 at a peripheral speed of 20 m/sec. or more to permit the melt to be solidified in amorphous form, and then to quench the thin amorphous metal band. The thickness of the thin metal band 8 can be adjusted by controlling the rotational speed of the cooling roll 7 or the peripheral speed of the cooling roll 7 within a range of 20 m/sec. or more in the case of the amorphous metal band. The thin metal band so obtained is preferably 20 to 80 $\mu m$ in thickness and, more preferably, 30 to 60 $\mu m$ in thickness in the case of the amorphous metal band.

The method as shown in FIG. 2 uses substantially the same arrangement as in FIG. 1, but uses a pair of rolls 10, 10 between which a cooling belt 11 runs. The cooling belt is cooled by a cooling device, not shown. According to this method, a melt in a container 3 is jetted from a nozzle 2 onto the cooling belt 11 and quenched on the running cooling belt 11 while being solidified to obtain a thin metal band 8. It is to be noted that the running speed of the cooling belt 11 corresponds to the peripheral speed of the cooling roll 7 in FIG. 1 and that the cooling belt 11 is made of the same material as that of the cooling roll 7. Since the melt 5 is jetted from the nozzle 2 onto the horizontal surface of the cooling belt, even if the longitudinal direction of the nozzle 2 is situated at a predetermined angle with respect to the direction of the width of the cooling belt 11 due to a swinging movement of the nozzle as will be set out below, no change occurs in the spacing between the nozzle 2 and the cooling belt 11. Thus, this method is better than the method of FIG. 1 where the distance between both the ends of the nozzle 2 and the cooling roll 7 is somewhat larger than the distance between the central portion of the nozzle 2 and the cooling roll 7 as a result of the swinging movement of the nozzle.

Figure 3:
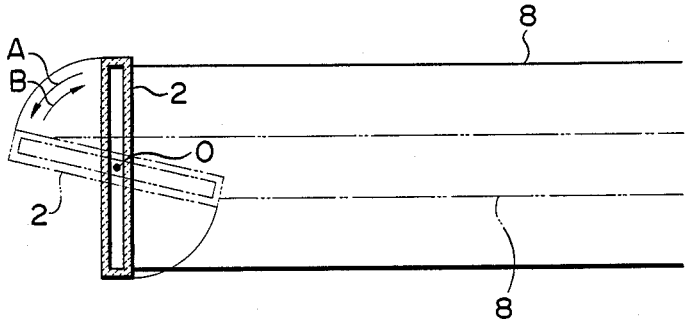
FIG. 3 is an explanatory view showing the step of adjusting the width of the thin metal band.

The method of this invention adjusts the width of a thin metal band while it is manufactured by quenching the above-mentioned melt. A method as shown in FIG. 3 is one example. According to this example, the nozzle 2 is swung in the direction of the width of the thin metal band with a mid-point on the axis of the nozzle 2 as a center, while the nozzle is placed opposite to the cooling roll 7 or the cooling belt 11. The nozzle has an elongated opening and, when it is located in parallel with the direction of the width of the metal band, the melt 5 jetted onto the cooling roll 7 or cooling belt 11 from the nozzle 2 has a width corresponding to the longitudinal length of the nozzle. As a result, it is possible to form a thin metal band at its maximum width. When the nozzle 2 is swung from the position as indicated by the solid line toward the position indicated by the dotted line in a direction of A with its mid-point on the central axis of the nozzle 2 as a center, the position of the nozzle opening varies across the width of the cooling belt 11 or the cooling roll 7, permitting the width of the melt 5 which is jetted from the nozzle 2 onto the cooling belt 11 or the cooling roll 7 to be sequentially narrowed as shown in FIG. 3. It is therefore possible to continuously or gradually adjust the width of the thin metal band 8 dependent upon the swinging angle of the nozzle 2.

Figure 4:
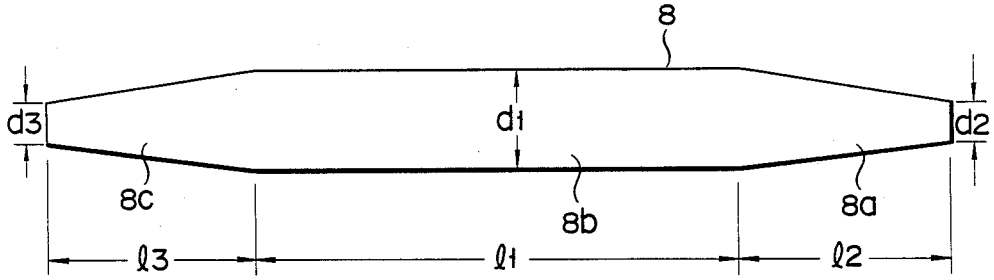
FIG. 4 is a plan view showing the configuration of the thin metal band adjusted by the width adjusting step.

The manufacture of a thin metal band 8 according to the method of this invention will be explained below by referring to FIGS. 3 and 4 conjointly.

First, the nozzle 2 is set to a position corresponding to a minimum width of a thin metal band by swinging the nozzle 2 at a predetermined angle in the direction indicated by A in FIG. 3. Then, melt 5 is jetted from the nozzle 2 onto the cooling roll 7 or cooling belt 11. Then, the nozzle 2, jetting the melt 5 onto the cooling roll 7 or cooling belt 11, is continuously swung in the direction of B toward the position indicated by the solid line in FIG. 3 to provide a section 8*a* of the thin metal band which continuously varies from a minimum width $d_2$ to a maximum width $d_1$. By jetting the melt 5 from the nozzle onto the cooling roll or cooling belt with the solid-line position of the nozzle maintained for a predetermined time period, a central section 8*b* having a maximum width $d_1$ is formed. Then, the nozzle 2, while jetting the melt 5 onto the cooling roll or cooling belt, is continuously swung from its solid-line position to the position corresponding to a minimum width $d_3$ to provide a section 8*c* of the thin metal band which continuously varies from the maximum width $d_1$ to the minimum width $d_3$. Here, it is to be noted that the lengths $l_2$ and $l_3$ of the sections 8*a* and 8*c*, respectively, are adjusted by the swinging speed of the nozzle 2, while on the other hand the length $l_1$ of the central section 8*b* is adjusted by varying the time over which the nozzle 2 is kept at the position indicated by the solid line in FIG. 3. Now suppose that the amount of melt jetted from the nozzle 2, and the rotational speed of the cooling roll 7 or the running speed of the cooling belt 11 are fixed. In this case, the sections 8*a* and 8*c* of the thin metal band 8 are somewhat greater in thickness than the thickness of the central section 8*b* thereof. Even if the thickness of each section of the metal band varies, such a variation is smaller, presenting no problem from the standpoint of the manufacture of the metal band and of the magnetic properties of the metal band. For example, three methods can be performed to obtain a metal band with uniform thickness: (1) a method for controlling pressure on the melt 5 within the container 3 whereby the amount of melt jetted from the nozzle is adjusted dependent upon the width of the metal band, (2) a method for controlling the rotational speed of the cooling roll 7 dependent upon the width of the metal band thereby adjusting the thickness of the metal band and (3) a method for combining the methods (1) and (2). It is better to swing an integral unit of the container 3 and nozzle 2 together with its supporting means (not shown).

Figure 5:
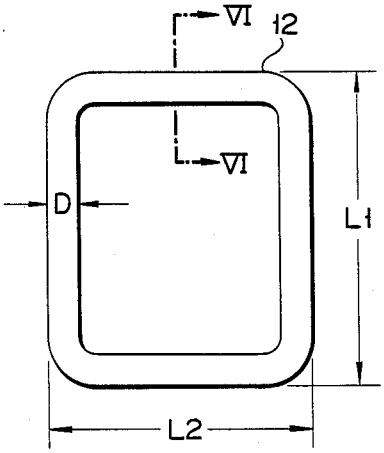
FIG. 5 is a plan view showing a winding core manufactured by winding the thin metal band.

The thin metal band 8 is, for example, so designed as to permit the cross-sectional configuration of a winding core 12 in FIG. 5, which is obtained by winding the thin metal band to approximate to a circular configuration. The extent to which the cross-sectional configuration of the winding core 12 approximates the circular configuration is dependent upon whether or not a wire can be coiled while rotating a split bobbin which is attached to the peripheral surface of the winding core 12. For example, the thin metal band may be so designed as to obtain a substantially octagonal cross-section, since a coil wire can be coiled around a split bobbin attached to the outer surface of the octagonal winding core. Stated in more detail, the winding core 12 having a substantially octagonal configuration can be obtained by properly setting the entire length of the thin metal band 8 to have the ratio $l_2:l_1:l_3$ as 1:1:1, and by setting the width ratio $d_2:d_1:d_3$ to be 1:3:1.

Figure 6:
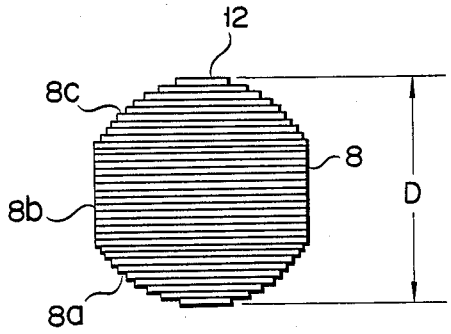
FIG. 6 is a cross-sectional view, taken along line IV—IV of the winding core of FIG. 5.

The thin metal band 8 is wound into a winding core 12 as shown in FIG. 5. The cross section of the winding core 12 approximates the stepped circular configuration shown in FIG. 6, since the width of each end portion of the thin metal band is gradually narrowed. It is to be noted that the winding core 12 has a polygonal cross section having at least parallel portions to which a split bobbin can be attached, so that a coil wire can be readily wound thereon while rotating the bobbin.

The winding core 12, like the conventional winding core, can be applied to a static induction machine, such as a transformer.

Figure 7:
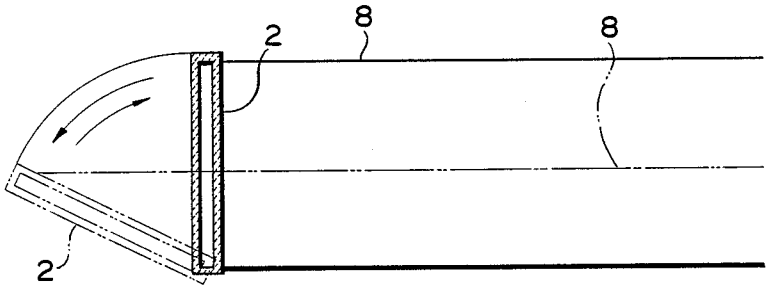
FIG. 7 shows another step of adjusting the width of the thin metal band.
Figure 8:
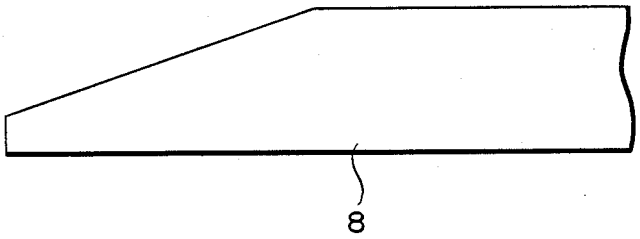
FIG. 8 is a plan view showing the portion of the thin metal band adjusted by the step of FIG. 8.

FIG. 7 shows another method of this invention which can adjust the width of a thin metal band during its manufacture. This method is different from the method of FIG. 3 in that a nozzle 2 is swung with one end thereof as a center to permit the width of the metal band to be adjusted. According to this method, the width of the thin metal band 8 is adjusted by varying only one side edge portion of the thin metal band 8. When such a thin metal band is wound, it is possible to obtain a winding core 12 having a substantially semi-circular cross section. The semi-circular winding core 12 is combined with another semi-circular winding core 12 having other magnetic properties to obtain a core unit of a circular cross section. The core unit, made up of a combination of, for example, a core of an amorphous alloy and a core of a silicon steel, provides combined magnetic properties, i.e., a lower iron loss derived from the amorphous alloy and a greater magnetic flux density derived from the silicon steel.

Figure 9:
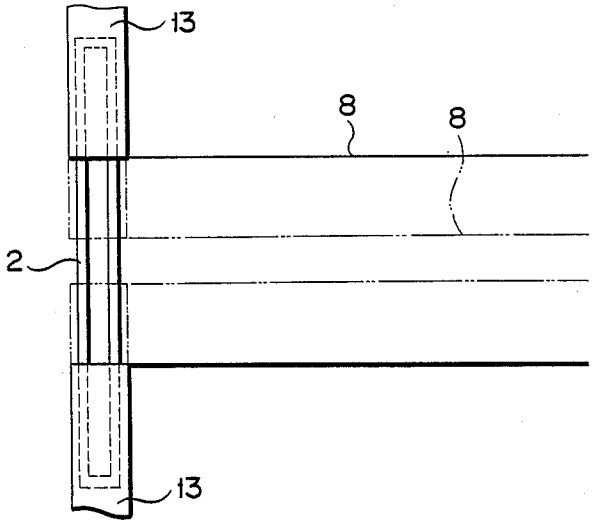
FIG. 9 shows another step of adjusting the width of the thin metal band with a nozzle viewed from below.
Figure 10:
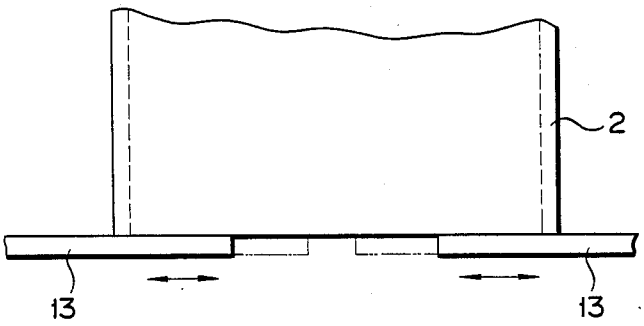
FIG. 10 is a front view showing the nozzle of FIG. 9.

FIGS. 9 and 10 show another method for adjusting the width of a thin metal band. A pair of plate-like, thermal shock-resistant, adjusting members 13, 13 are slidably arranged on the lower open end of the nozzle 2 or along grooves provided in the lower open end of the nozzle 2. This permits the length of the nozzle opening to be varied which allows the width of a melt 5 and thus the thin metal band to be adjusted. According to this method, the adjusting members 13, 13 can be slidably moved according to the width of the thin metal band. It is therefore possible to adjust the opening area of the nozzle 2 and thus to control the flow of the melt through the nozzle 2. As a result, the thickness of the thin metal band 8 can be maintained uniformly over the whole area of the metal band. This method can be applied to the above-mentioned embodiment, but is not restricted thereto.

This invention can be effectively applied not only to the manufacture of a thin metal band of an amorphous magnetic alloy having an excellent magnetic property such as a lower iron loss, but also to the manufacture of the other magnetic alloy band, such as a silicon steel band or permalloy band.

According to this invention, the angle or the width of the nozzle through which the melt is jetted can be varied to obtain a thin metal band including the gradually narrowing sections. During the manufacture of the thin metal band through the quenching of the cooling roll or cooling belt, the width of each section of the thin metal band can also be adjusted according to the cross-sectional configuration of the winding core. This method obviates the necessity of effecting, for example, any additional cutting step for narrowing the width of the side edge or edges of each end portion of the thin metal band. As a result, the number of steps required for the manufacture of the thin metal band can be decreased, assuring a high yield of winding cores. According to this invention, a burr-free winding core of a predetermined cross section can be readily manufactured. It is also possible to prevent a possible shorting between the turns of the winding core due to the presence of such a burr.

EXAMPLES

Thin metal bands made of an amorphous, magnetic alloy were manufactured by a method of FIGS. 1 and 3 using two kinds of molten magnetic alloys. The metal band was coiled into a winding core. In this connection it is to be noted that the winding core was manufactured under the following conditions.

1. Melt of the magnetic alloy

Example 1:
composition (atomic percent): Fe 75%, Si 10%, B 15%,
temperature: about 1450° C.
Example 2:
composition (atomic percent): Co 67.5%, Fe 7.5%, Si 10%, B 15%.
temperature: about 1350° C.

2. Pressure on the melt compression gas: argon gas
compression force: about 0.1 kg/cm$^2$ 3. Nozzle dimension: 25.5 mm×0.5 mm
material: quartz 4. Cooling roll material: chromium-zirconium-copper alloy
dimension: outer diameter: 500 mmϕ, width: 200 mm,
number of rotations: about 850 R.P.M. (peripheral speed: 24 m/sec.)

As a result of the experiments conducted, the following results were obtained:

1: Thin metal band obtained (see FIG. 4)

thickness: 35μ (average value)
width: $d_1$=about 25.5 mm, $d_2$=$d_3$=about 8 mm
length: $l_1$=about 200 mm, $l_2$=$l_3$=about 200 mm 2: Winding core obtained dimension: $L_1$=about 200 mm, $L_2$=about 400 mm
cross section: D=about 25 mm
number of turns: about 600

What is claimed is:

1. A method for manufacturing a thin metal band, comprising the steps of gradually increasing the width of the thin metal band from one end thereof toward a central section to be formed, maintaining the width of the metal band uniform for a predetermined time period to provide said central section and gradually decreasing the width of the metal band from the central section toward the other end.

2. A method according to claim 1, in which as a material for said thin metal band use is made of a crystalline magnetic material.

3. A method according to claim 2, in which said crystalline magnetic material is selected from the group consisting of a silicon steel and permalloy.

4. A method according to claim 1, in which the composition of said thin metal band is comprised of 70 to 80 atomic percent of one or more kinds of metals selected from the group consisting of Fe, Ni and Co and 20 to 30 atomic percent of one or more kinds of metalloids selected from the group consisting of Si, B, P, C, Al and Ge.

5. A method according to claim 4, in which said thin metal band has a thickness of 20 to 80 μm.

6. A method according to claim 1, in which the composition of said thin metal band is comprised of 60 to 80 atomic percent of one or more kinds of metals selected from the group of Fe, Ni and Co, 20 to 30 atomic percent of one or more kinds of metalloids selected from the group consisting of Si, B, P, C, Al and Ge, and less than 10 atomic percent of one or more selected from transition metal elements.

7. A method for manufacturing a thin metal band, which method comprises the steps of continuously varying the width of the thin metal band, while manufacturing the thin metal band through the melt quenching of molten magnetic metal, said melt quenching being practiced by the steps of jetting said melt onto the outer surface of a rotating cooling roll from a rectangular nozzle opening, while at the same time adjusting the width of the thin metal band.

8. A method according to claim 7, in which said melt is jetted from said nozzle under an inert gas pressure of 0.1 to 0.5 kg/cm$^2$.

9. A method according to claim 8, in which said inert gas is an argon gas.

10. A method according to claim 7, in which the peripheral speed of said cooling roll is above 20 m/sec.

11. A method according to claim 10, in which during the metal width adjusting step, the peripheral speed of said cooling roll is controlled according to a variation in the width of the thin metal band to be obtained, whereby the flow of the melt onto the roll or the belt is controlled.

12. A method according to claim 7, in which said metal band adjusting step comprises adjusting the width of said metal band by swinging said nozzle in a predetermined angle range with the width direction of said cooling roll with a midpoint on the center axis of said nozzle as a center.

13. A method according to claim 12, in which during the metal width adjusting step an inert gas pressure which is applied to the melt jetted from the nozzle is controlled according to the width of said thin metal band to be obtained, whereby a flow of said melt through the nozzle is controlled.

14. A method according to claim 12, in which during the metal band width adjusting step, an inert gas pressure on the melt to be jetted and the peripheral speed of the cooling roll are controlled according to a change in the width of the thin metal band to be obtained, whereby the flow of the melt onto the roll or the belt is controlled.

15. A method according to claim 12, in which during the metal band adjusting step an inert gas pressure on the melt to be jetted from the nozzle is controlled according to a change in the width of the metal band to be obtained, whereby the flow of the melt through the nozzle is controlled.

16. A method according to claim 7, in which said metal band adjusting step comprises adjusting the width of said metal band by swinging said nozzle in a predetermined angle range with the width of said cooling roll with one end of said nozzle as a center.

17. A method according to claim 16, in which during the metal band width adjusting step the peripheral speed of said cooling roll is controlled according to a change in the width of the thin metal band to be obtained, whereby the flow of the melt onto the roll or the belt is controlled.

18. A method according to claim 16, in which during the metal band width adjusting step an inert gas pressure on the metal to be jetted from the nozzle and the peripheral speed of the cooling roll is controlled according to a change in the width of the thin metal band to be obtained, whereby the flow of the melt onto the roll or the belt is controlled.

19. A method according to claim 7, in which said metal band width adjusting step comprises slidably disposing a pair of plate-like adjusting members on the opposite ends of said nozzle opening or along grooves provided with respect to the nozzle opening, and slidably moving the plate-like members to vary the nozzle opening length as viewed in a direction of the width of said cooling roll.

20. A method for manufacturing a thin metal band, which method comprises the steps of continuously varying the width of the thin metal band, while manufacturing the thin metal band through the melt quenching of molten magnetic metal, said melt quenching being practiced by the steps of jetting a melt onto the outer surface of a running cooling belt from a rectangular nozzle opening, while at the same time adjusting the width of the thin metal band.

21. A method according to claim 20 in which said melt is jetted from said nozzle under an inert gas pressure of 0.1 to 0.5 kg/cm$^2$.

22. A method according to claim 21 in which said inert gas is an argon gas.

23. A method according to claim 20 in which the running speed of said cooling belt is above 20 m/sec.

24. A method according to claim 23 in which during the metal width adjusting step, the running speed of said cooling belt is controlled according to a variation in the width of the thin metal band to be obtained, whereby the flow of the melt onto the roll or the belt is controlled.

25. A method according to claim 20 in which said metal band adjusting step comprises adjusting the width of said metal band by swinging said nozzle in a predetermined angle range with the width direction of said cooling belt with a midpoint on the center axis of said nozzle as a center.

26. A method according to claim 25 in which during the metal width adjusting step an inert gas pressure which is applied to the melt jetted from the nozzle is controlled according to the width of said thin metal band to be obtained, whereby a flow of said melt through the nozzle is controlled.

27. A method according to claim 25 in which during the metal band adjusting step an inert gas pressure on the melt to be jetted from the nozzle is controlled according to a change in the width of the metal band to be obtained, whereby the flow of the melt through the nozzle is controlled.

28. A method according to claim 20 in which said metal band adjusting step comprises adjusting the width of said metal band by swinging said nozzle in a predetermined angle range with the width of said cooling belt with one end of said nozzle as a center.

29. A method according to claim 28 in which during the metal band width adjusting step, an inert gas pressure on the melt to be jetted and the running speed of the cooling belt is controlled according to a change in the width of the thin metal band to be obtained, whereby the flow of the melt onto the roll or the belt is controlled.

30. A method according to claim 28 in which during the metal band width adjusting step the running speed of said cooling belt is controlled according to a change in the width of the thin metal band to be obtained, whereby the flow of the melt onto the roll or the belt is controlled.

31. A method according to claim 28 in which during the metal band width adjusting step an inert gas pressure on the melt to be jetted from the nozzle and the running speed of the cooling belt is controlled according to a change in the width of the thin metal band to be obtained, whereby the flow of the melt onto the roll or the belt is controlled.

32. A method according to claim 20 in which said metal band width step comprises slidably disposing a pair of plate-like adjusting members on the opposite ends of said nozzle opening or along grooves provided with respect to the nozzle opening, and slidably moving the plate-like members to vary the nozzle opening length as viewed in a direction of the width of said cooling belt.

* * * * *

UNITED STATES PATENT AND TRADEMARK OFFICE

CERTIFICATE OF CORRECTION

PATENT NO. : 4,570,695

DATED : February 18, 1986

INVENTOR(S) : Takashi Ishii, Shinichi Murata, Shiro Kusagawa, Miyoshi Wakasaki

It is certified that error appears in the above—identified patent and that said Letters Patent is hereby corrected as shown below:

On the title page

Change "[73] Assignee: Tokyo Shibaura Denki Kabushiki Kaisha, Japan" to --[73] Assignee: Tokyo Shibaura Denki Kabushiki Kaisha, Kawasaki, Japan--.

Signed and Sealed this

*Twelfth* Day of *August 1986*

[SEAL]

*Attest:*

*Attesting Officer*

DONALD J. QUIGG

*Commissioner of Patents and Trademarks*